US009481948B2

(12) United States Patent
Branscomb et al.

(10) Patent No.: US 9,481,948 B2
(45) **Date of Patent: *Nov. 1, 2016**

(54) ROBUST PRE-IMPREGNATED YARN FOR MANUFACTURING TEXTILE COMPOSITES

(71) Applicant: AUBURN UNIVERSITY, Auburn, AL (US)

(72) Inventors: David J. Branscomb, Sheffield, AL (US); Roy M. Broughton, Jr., Opelika, AL (US); David G. Beale, Auburn, AL (US)

(73) Assignee: Auburn University, Auburn, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/864,141

(22) Filed: Apr. 16, 2013

(65) Prior Publication Data

US 2013/0302604 A1 Nov. 14, 2013

Related U.S. Application Data

(60) Provisional application No. 61/624,534, filed on Apr. 16, 2012.

(51) Int. Cl.

| | |
|---|---|
| ***D02G 3/44*** | (2006.01) |
| ***D02G 3/36*** | (2006.01) |
| ***D02G 3/40*** | (2006.01) |
| ***D04C 1/12*** | (2006.01) |

(52) U.S. Cl.

CPC *D02G 3/44* (2013.01); *D02G 3/36* (2013.01); *D02G 3/40* (2013.01); *D02G 3/442* (2013.01); *D04C 1/12* (2013.01); *D10B 2505/02* (2013.01); *Y10T 428/2915* (2015.01); *Y10T 428/2918* (2015.01); *Y10T 428/2931* (2015.01)

(58) Field of Classification Search

None

See application file for complete search history.

(56) References Cited

U.S. PATENT DOCUMENTS

| | | | | |
|---|---|---|---|---|
| 4,677,818 | A * | 7/1987 | Honda et al. | 57/224 |
| 5,307,615 | A * | 5/1994 | Walton et al. | 57/214 |
| 5,899,134 | A * | 5/1999 | Klein et al. | 87/9 |
| 7,132,027 | B2 * | 11/2006 | Jensen | 156/175 |
| 2010/0181012 | A1 * | 7/2010 | Hiel et al. | 156/180 |
| 2011/0061519 | A1 * | 3/2011 | Fields | 87/2 |

* cited by examiner

*Primary Examiner* — Hai Vo

(74) *Attorney, Agent, or Firm* — Blake P. Hurt; Tuggle Duggins P.A.

(57) ABSTRACT

A composite prepreg yarn designed and constructed is a very large, strong yarn with resin infused throughout, which can be used to prepare composite preforms via conventional Maypole braiding or other textile processes. The invention increases the loads that can be transmitted by the cured yarn in a composite structure, decreases the stickiness that can prevent their use in braiding and other textile processes, provides protection to the high-strength fibers from abrasion that is encountered during and after composite preform manufacturing via braiding.

13 Claims, 6 Drawing Sheets

ROBUST PRE-IMPREGNATED YARN FOR MANUFACTURING TEXTILE COMPOSITES

CROSS-REFERENCE TO RELATED APPLICATION

The present application claims priority to U.S. provisional application No. 61/624,534, filed on Apr. 16, 2012, and hereby incorporates the subject matter of the provisional application in its entirety.

BACKGROUND OF THE INVENTION

1. Field of the Invention

This invention relates to the field of composite textiles, particularly to yarns, tows and structural members suitable for manufacturing fiber reinforced composites. This invention enables the production of robust pre impregnated yarns that are easily wound onto spools and processed on conventional textile machinery such as a Maypole braiding machine without difficulty.

2. Brief Description of Related Art

Several process techniques are commonly used for making fiber reinforced composites. These include:

1. Weaving, braiding, or winding of yarns (or tows) into flat fabric or shaped tubular preforms followed by saturation of the preform by liquid resin and then curing to harden the resin, 2. The fabric preforms in 1) may be stacked and painted with liquid resin, one layer at a time, stacked wet in a mold to make a solid shape, then cured under a vacuum bag or in an autoclave to harden the resin.

3. Fabric preforms in 1) may be vacuum or pressure infused with liquid resin followed by curing to harden the resin.

4. The yarns/tows may be resin impregnated (or be pre-impregnated yarns) before braiding or weaving and then cured afterwards. The resin may be partially cured before braiding and then curing is finished after braiding.

5. The yarns or tows may be resin impregnated and then used directly in a process called filament winding to make a structure, usually over a mold or mandrel, and subsequently cured to harden the resin, 6. The yarns or tows may be resin impregnated and pulled through a heated die to shape and cure the composite simultaneously (in a process called pultrusion).

7. The fibers may be chopped and sprayed simultaneously with liquid resin onto a mold. The mixture is then cured in place.

The list above is not intended to be all inclusive, and curing may or may not require heat. Liquid resin is a complex mixture of monomers, prepolymers and catalysts. Resin is usually viscous, thus limiting its ability to flow and thoroughly impregnate thick layers of compacted fiber.

The subject of this invention is included in technique number 4 above—large prepreg yarns are created from an assembly of small, thoroughly infused prepreg yarns, held together by a fibrous or polymer jacket. The large prepreg yarns are then braided or woven into a shaped composite preform and subsequently cured by heating. The prepreg yarn may be partially cured before braiding or weaving.

Fibers are infused with a polymer resin and cured to harden in order to generate a composite material. This process is relatively simple for making thin composites, but problems arise when a laminate or yarn is thick. It is difficult to infuse resin through a thick material completely to the center. To mitigate this problem, manufacturers have developed prepreg materials, which have the resin already present in the material. After making a structure, there is no required infusion, and the structure can be cured directly. Using prepreg materials will ensure that resin fills the entirety of the composite material, for maximum strength and reliability. However, prepreg yarns are particularly sticky, and therefore not generally considered suitable for braiding, weaving, or a number of other manufacturing processes.

In addition, two of the most used fibers for composite manufacture are carbon and glass. Both these fibers suffer from being excessively brittle and fragile. They break easily when subjected to abrasion in textile processing. While resin saturation of the fibers improves the abrasion resistance, it is still not good, and the resin saturation comes at the price of stickiness.

Yarns which are components in fiber reinforced composites must be thoroughly saturated with (typically a viscous) resin to make the composite. Since saturation is difficult for large assemblies of fibers, the fibrous assembly must therefore be small, or flattened into a wide, thin ribbon in order for the resin to penetrate thoroughly. These units of saturated fibers are called prepreg yarns or prepreg tows. As fiber reinforced composites are all composed of fibers infused and surrounded by a matrix resin, and given the difficulty of infusing large fiber bundles, one objective of this invention is the production of a large, thoroughly resin infused fiber bundle or yarn suitable for composite manufacture.

To make a larger yarn or structural unit, the small, resin-saturated assemblies of fibers may be combined into parallel bundles, but these bundles need to be held together. Twisting of a fiber bundle is the most common method of ensuring that fibers remain with the fiber bundle, but twisting lowers alignment of fibers in the axial direction of the yarn and reduces fiber strength. Some constraint such as a braided, wrapped or extruded overlayer can allow the fibers to remain in axial alignment while maintaining the integrity of the fiber bundle. Although the extruded overlayer is a common method of constraining a core of fibers (particularly wire) and is included in the invention, the braided or wrapped construction of the overlayer produces a more flexible yarn structure than an extruded overlayer. The winding onto spools and the interlacing on conventional equipment is more difficult with the extruded overlayer. On the other hand, the extruded overlayer is better at containing the prepreg yarn core than a braid or wrap. It is one purpose of this invention to produce very large prepreg yarns which maintain both structural integrity (a contained core with aligned filaments and no splitting), and sufficient flexibility to allow processing on conventional textile manufacturing equipment like a braiding machine The core fibers must be contained in such a way that they are permitted to move freely around the carrier eyelets and pulleys while preserving their parallel orientation along the axis of the yarn. Another objective of this invention is to provide a jacket of minimum weight to protect, contain, and efficiently consolidate the core fibers A particular difficulty of converting the prepreg yarns or tows into a composite structure is the stickiness of the prepreg yarn, which creates difficulty in braiding or weaving. Therefore filament winding is the preferred method of assembling the prepreg yarns or tows into a composite preform. However, the filament wound structure suffers from the lack of yarn interlacing, making the final cured composite structure subject to splitting and delamination. Another purpose of this invention is to produce a prepreg yarn that can be easily converted to an interlaced fabric or shaped preform by braiding or perhaps weaving on typical textile fabrication machinery.

Preferred fibers for reinforcing composites are often carbon and glass, because of their strength and stiffness. As both of these fibers are brittle and suffer from failure caused by abrasion, another object of this invention is the protection of these brittle fibers from abrasion damage.

Fibers are strongest in their own axial direction, but not necessarily in their other directions. Generally, when individual fibers are made into a yarn or rope, it is necessary to impart some amount of twist, in order to keep the fibers together, at least during the processes of making yarn, winding on spools and conversion into a textile structure. In the resulting yarn geometry, the axial direction of the yarn is not the same as the axial direction of many or all of the fibers. The result is a proportional reduction in strength based on the pitch of the fibers. It is another purpose of this invention to produce a braidable prepreg yarn wherein almost all of the fibers are aligned close to the yarn axis.

Both weaving and braiding provide interlaced structures. Weaving typically produces a flat fabric, while braiding can produce either flat or cylindrical fabric. Further, the cylindrical braided structure can be easily shaped to polygon structures, and is easily varied in cross sectional area and shape during braiding. Braiding is often the most desirable method for producing shaped thin composites. Therefore the products produced by this invention are particularly useful in producing braided structures.

Braided structures range in size from medical sutures and shoestrings to large marine ropes for securing ships and drilling platforms. Our examples are manufactured on typical textile braiding machines. It is anticipated that the yarn size produced by this invention will be scalable so that as the size of the braiding machine carriers and bobbins increase, the yarn size that is braidable will also increase.

DESCRIPTION OF THE PRIOR ART

Braiding around a core of axially aligned fibers is not new. One can find dozens of examples in a typical hardware store, in the form of ropes, clothes lines, and any number of cables including some made of metal wire. Specialized ropes for mountain climbing consist of axially aligned high strength fiber in the core, surrounded by an abrasion resistant braided jacket. The structural elements of braided rugs are often a braided jacket surrounding a core of fibers, which may not be aligned in the axial direction of the yarn.

Elastic yarns in clothing like socks usually consist of axially aligned elastomeric fibers covered by a wrapping of cotton yarn to minimize the friction (stickiness) between the yarn and the human body.

The subject of this invention is described above—large prepreg yarns created from an assembly of small, thoroughly infused prepreg yarns, held together by a fibrous or polymer jacket. The large prepreg yarns are then braided or woven into a shaped composite preform and subsequently cured by heating. The prepreg yarn may be partially cured before braiding or weaving.

The patent art suggests wrapping of biaxial, Maypole braiding around a resin saturated yarn (U.S. Pat. Nos. 3,644,866, 2,684,318, 7,132,027, and EP 1401378) but an uncritical application of these techniques will not produce a large, robust, braidable yarn. The structural features necessary for winding a yarn on spools, passing it over guides, eyelets, and rollers and sliding it between other yarns at the braid point or the fell of the cloth in weaving—all without damage—requires close attention to the fine details of the manufacturing process and how the yarn interacts with it. In particular, a biaxial braided jacket over a large prepreg yarn will not allow sufficient flexibility unless the braid angle is somewhat less than the compressive jammed state. On the other hand, if the braid angle moves substantially away from the compressive jammed state, the jacket tends to open up and the prepreg core pops out of the jacket as the yarn is bent over guides and small rollers.

A normal triaxial braid is somewhat better than a biaxial braid in that the axials restrain the core within the jacket better than the biaxial braid. The most efficient way of containing the core within the jacket seems to be the true triaxial braid in which the axials interlace with the helicals (U.S. Pat. No. 5,899,134). Both axial constructions restrain the core better at lower cover factor (lower weight) than the biaxial braid.

The prior art ignores these characteristics of a braided jacket over core construction, and without attention to these details (as revealed in this invention); the manufacture of a robust braidable yarn is not possible. Previous inventions and the associated literature (U.S. Pat. No. 7,132,027) do not specify or discuss the aforementioned structural features necessary for the covering layer to perform the intended purpose of the currently disclosed yarn structure. Perhaps this is because the previous art does not anticipate a large yarn that is spoolable, braidable or weavable. Indeed the claims of U.S. Pat. No. 7,132,027 anticipates the use of the braiding of dry yarn rather than prepreg, as the saturation of yarn with resin is listed as a step after braiding in the patent.

BRIEF SUMMARY OF THE INVENTION

The present invention discloses a braidable prepreg yarn. It contains two basic components; a core containing fiber and resin, and a protective jacket. The core is comprised of a number of prepreg tows. Prepreg tows are commercially available as resin infused fiber bundles containing 3000 to 12000 individual fibers or more. A tow with 3000 individual filaments is identified as a 3K tow. The inventors have used carbon fiber, but others such as glass, para-aramid, liquid crystal polyester (LCP), and any other high strength fiber may be used. These tows already include a requisite amount of resin that will cure and give strength and stiffness to the yarn. The prepreg tows are typically 40-70% fiber by volume. The individual fibers comprising each tow are all essentially axial fibers, with no substantial twist. This provides the maximum axial strength for the tow.

Several tows are compacted together to form a dense core. If the resin were not already present, it would not be expected that resin would be able to penetrate the dense collection of fibers and reach the center of the core. The large core is composed of very many, densely packed, axial fibers. It is very strong in the axial direction, but susceptible to buckling and splitting, as well as abrasion damage during braiding. In fact, the core is often too sticky to braid well. The fibers stick to each other and will not slide past one another to form a compact braid. Also the resin is sticky and adheres to various points of contact on the braiding machine. For these reasons, a protective jacket is placed over the core. Three embodiments of the protective jacket are envisioned:

1. a braided jacket,
2. a fiber-wrapped jacket, and
3. an extruded thermoplastic jacket.

For embodiments 1 and 2 of the protective jacket, the strength of the jacket fiber is not as important as for the core. The jacket fibers should protect the core and so the core fibers should not break easily. The jacket should provide abrasion resistance for the core. The protective jacket should also contain the stickiness of the core, allowing the assembly to slide over machinery parts and other yarns without sticking. If the protective jacket is braided or wrapped fibers, there should be sufficient resin in the core that it bleeds through the jacket and bonds the structural members together at their intersecting points in the composite structure. In embodiment 3, the solid thermoplastic coating will contain the stickiness and provide the bonding between the structural elements provided that the curing temperature is sufficiently high to melt the thermoplastic jacket resulting in a strong polymer weld between the structural members at their intersection points. Nylons are the preferred thermoplastic jacket materials, but polyolefins, polyesters, and other thermoplastic jackets are envisioned to be acceptable jacket materials. Thermoplastic fibers, if used in braided or wrapped jacket, may also be melted to form a bond between the prepreg yarns.

The protective jacket braided by the inventors might be a conventional Maypole braid, a braid with axials, or a true triaxial braid (U.S. Pat. No. 5,899,134). A conventional braid at close to 100% coverage, significantly reduces the stickiness of the yarn, holds in most of the resin, and provides a high level of abrasion resistance. An open, true triaxial braid (U.S. Pat. No. 5,899,134) can offer sufficient protection, limit the stickiness, and allow more resin to leave the prepreg to assist in the bonding of yarns at joints. Jackets hold the core in a more circular cross section making it a stiff member, able to transmit large compressive axial and bending loads far better and more efficiently than a flat tape cross section.

DETAILED DESCRIPTION OF THE INVENTION

Figure 1:
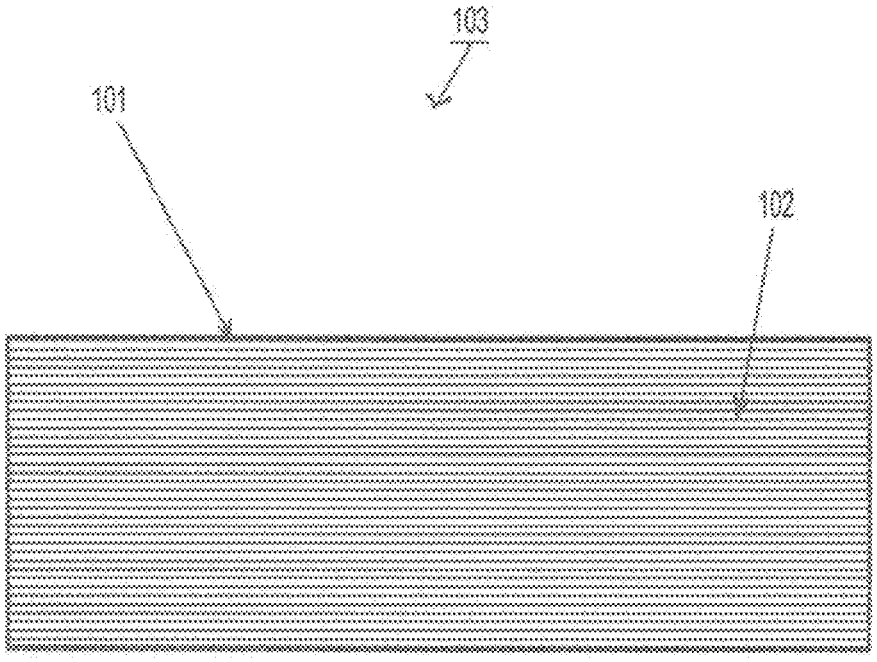
FIG. 1 shows an elevated side view of a core of a jacketed yarn.

Referring first to FIG. 1, the core (101) of the yarn (100) is shown. The core (101) may be comprised of a plurality (i.e. one or more) of prepreg tows (103). The tows (103) are arranged essentially axially, with no significant component of twist. Each tow (103) is further comprised of many small diameter fibers (102), and each fiber (102) is also oriented substantially axially with respect to the tow (103), and therefore with respect to the core (101) as well. The tows (103) are compacted together in order to maximize the density of the core (101). This compaction will assist in providing stability to the core (101). It is shown that the tows (103) are compacted in the core (101) to a polygon shape, often a substantially hexagonal cross section (see FIG. 2). As a result, the tows (103) are arranged within the core (101) in a close packed configuration which often gives them the appearance of being a hexagonal close packed structure, which indicates a high density for the material. This density requires that the tows (103) already include resin (not shown), because it is very difficult to infuse resin through such a thick and dense core (101).

Continuing to look at FIG. 1, an embodiment of prepreg yarn (100) is not shown. Generally, a yarn (100) cannot be made entirely of axial fibers such as axial fibers (102). Axial fibers with no twist have little or no cohesion to one another, and therefore separate very easily. They are susceptible to buckling, and they are also susceptible to breaking. The core (101) as shown in FIG. 1 is preferably contained as described in more detail below.

Figure 2:
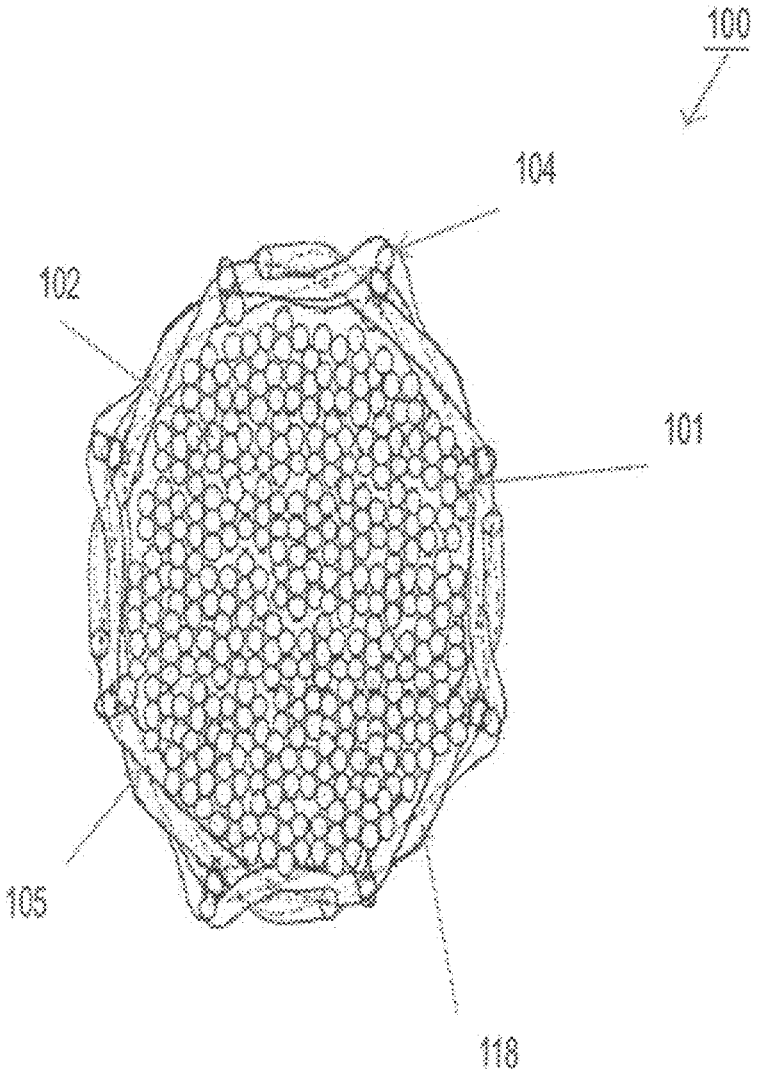
FIG. 2 shows an elevated cross section view of the yarn of a jacketed yarn.

Looking now at FIG. 2, the jacketed yarn (100) is shown in a circular cross-section view, which includes the core (101) surrounded by a protective jacket (118). The number of axial fibers or filaments (102) in the core (101) cross section easily numbers 36000 or more and cannot be represented to scale in size or number, so FIG. 2 is a schematic representation of the cross section. The jacket (118) provides not only protection, but also binds the tows (103) of the core (101) together, helps to contain the resin (not shown) that is pre-impregnated into the tows (103) during subsequent textile processes, and limits the stickiness of the yarn (100) as a whole. The jacket (118) in most embodiments should be made of high-performance fibers, which can include aramids, polyethylene fibers, or LCP. In one or more alternative embodiments, the jacket (118) may be formed from prepreg tows (103), for example serving as the axial fibers (102). Conventional nylons, polyesters and other thermoplastics may also be used in the jacket (118). There are numerous embodiments for the jacket (118) and only a few embodiments are listed herein. The inventors use various braids to accomplish multiple embodiments, but wrapping (see FIG. 6), extruding, and other methods can also be utilized. The method used does not substantially change the invention, alternative embodiments are contemplated within the scope of the instant invention, and may be selected based on the features needed case by case. The embodiment of the jacket (118) includes helical wrapping and interlacing yarns (105) and that follow helical paths that are either clockwise or counterclockwise around and about axial fibers (104) that are laid in the structure or wrapping, helical yarns (105).

Figure 3:
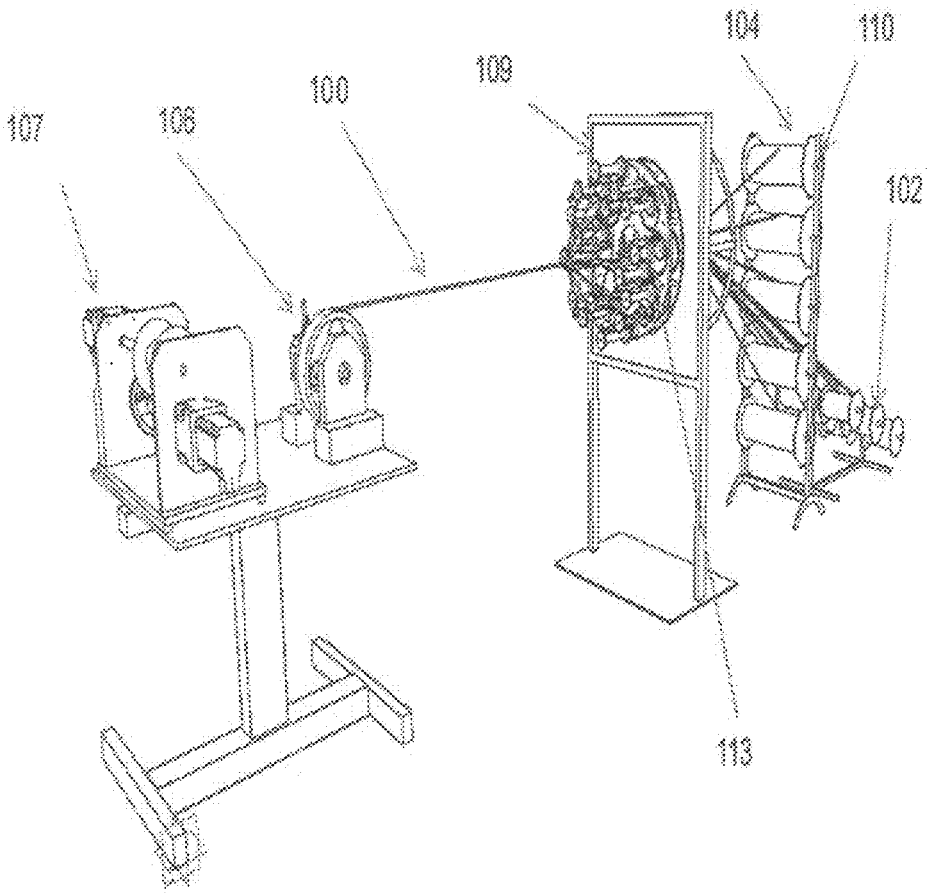
FIG. 3 is a side perspective view of a schematic of a braider forming the jacketed yarn of FIG. 2.

FIG. 3 represents a schematic of the equipment used to assemble one or more embodiments of the prepreg fibers (102) into the core (101) and construct a braided jacket (118) around the core (101). The equipment preferably consists of a braiding machine, a take up stand spool (106) and driver (107), a yarn creel (110) feeding both core fibers (102) and axial fibers (104) and a Maypole braider (109) with carriers and bobbins (113) all braiding to produce a jacketed prepreg yarn (100).

Figure 4:
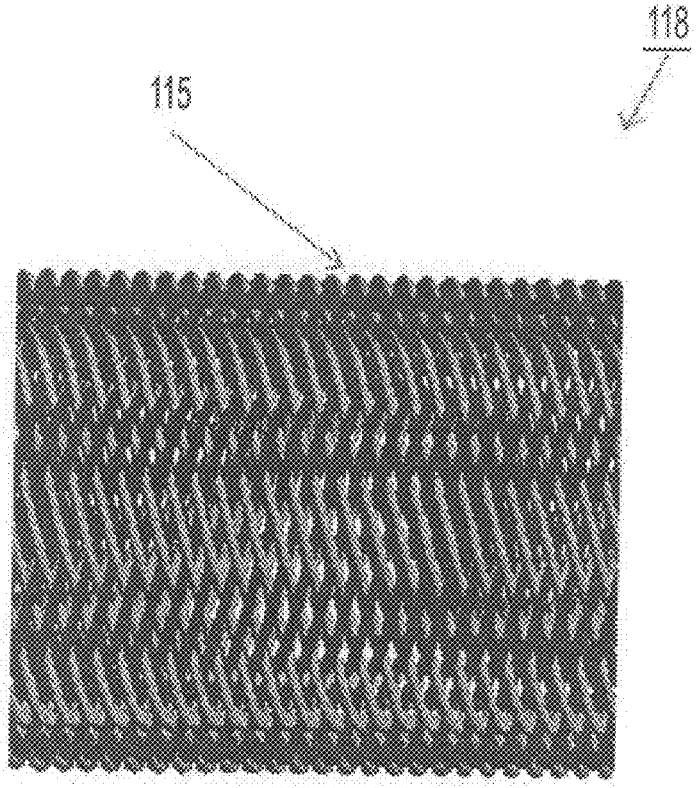
FIG. 4 shows an elevated side view of an alternate embodiment of the jacket of FIG. 2.

FIG. 4, represents one embodiment for the jacket (118), a conventional biaxial Maypole braid (115) over the core (101). Such a braid is straightforward and simple. The coverage of the core (101) with an embodiment of jacket (118) approaches 100%. The full coverage of core (101) soaks up more of the resin (not shown) that exudes from the core (101) during curing and perhaps reduces the bonding between fibers (104, 105) at crossover intersections. The full coverage jacket (118) also minimizes the stickiness and abrasion suffered by the core (101). The danger is that full coverage may result in the compressive jammed state and stiffen the yarn (100). It is important that the braided jacket (118) not be in the compressive jammed state (see for example *Structural Analysis of a Two-dimensional Braided Fabric*, Q. Zhang, D. Beale, S. Adanur, R. M. Broughton, R. P. Walker, Vol. 88(1), 1997), as the yarn may exhibit too much stiffness to be wound on the braider bobbins (113) for the subsequent formation of the composite preform. On the other hand, as the braid angle decreases from the compressive jammed state, the braided jacket (118) is more likely to open up during bending around yarn guides and allow the core (101) to pop out of the protective jacket (118). (The braid angle is defined as the acute angle between the yarn axis and the braiding yarns). It will be appreciated by those skilled in the art that the natural compression jammed state diameter of the jacked jacketed braid (118) should not be greater than the diameter of the core (101).

Figure 5:
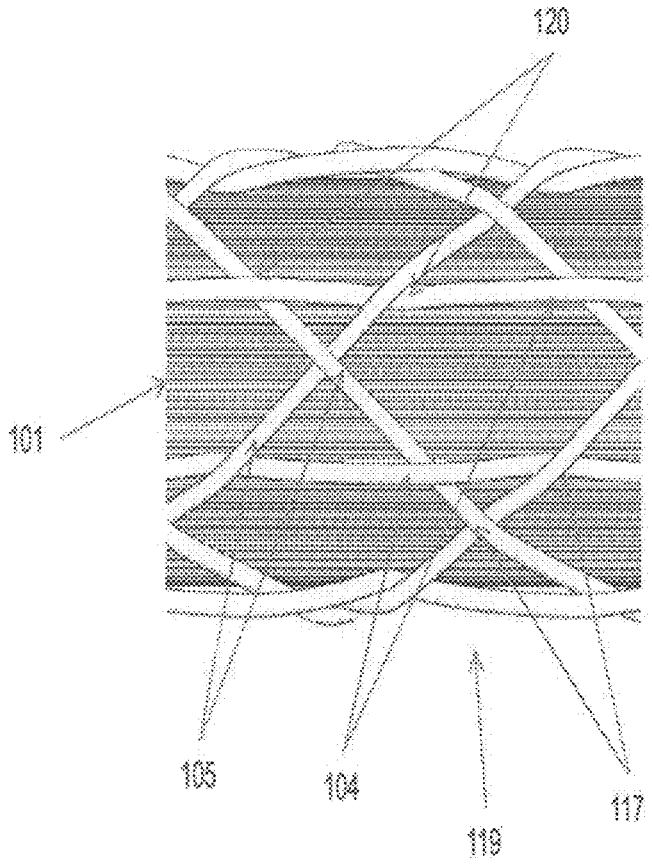
FIG. 5 shows an elevated side view of an alternate embodiment of a jacketed yarn.

Looking now at FIG. 5, another preferred embodiment of jacket (118) includes an open true triaxial braid jacket (119) over the core (101). In this embodiment, the jacket (119) is made as an open braid, such as a true triaxial braid. The axial fibers (104) actually interlace (120) with the helical fibers (105). The axial fibers (104) may consist of prepreg tows (104), Since the braided jacket (119) is open, the coverage is much less than 100%. This configuration may be desired for a number of reasons. The open braid will allow some of the resin to escape from the core (101) during curing. The escaping resin (not shown) serves the purpose of bonding fibers (104, 105) together at their intersections to produce a composite structure. Anywhere two fibers (104, 105) come in contact, for example at intersection points (117), joints need to be formed to stabilize the composite structure. The amount of resin will be enough to bond the joints between the fibers (104, 105) if one pays attention to the fiber volume fraction in the prepreg. It is important to provide sufficient coverage with the open braided jacket (119) so that the yarn (100) does not become too sticky to braid and the core (101) does not pop out of the protective jacket (118, 119). The open jacket (119) reduces total weight.

Figure 6:
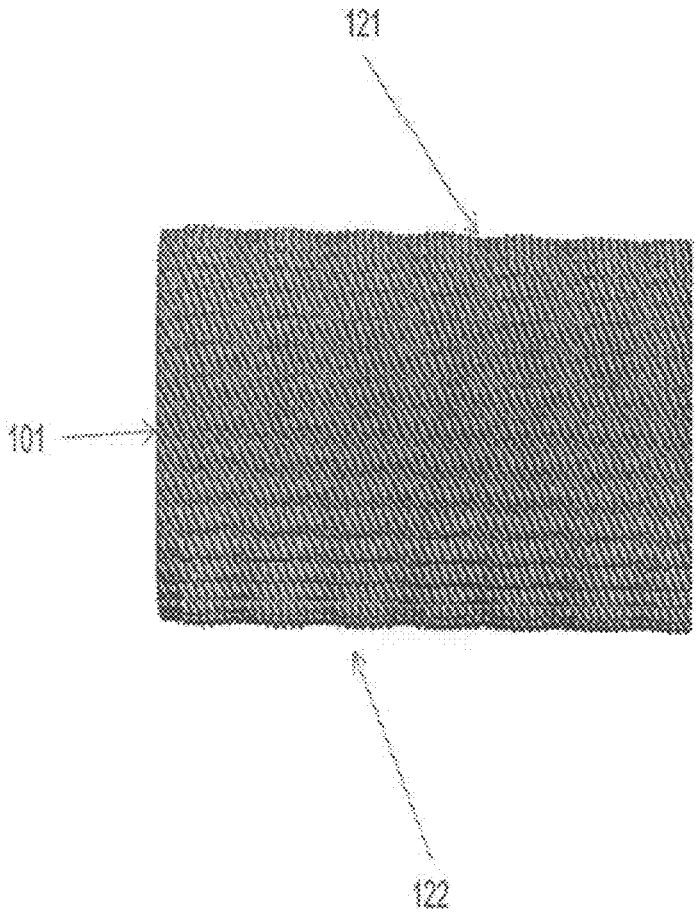
FIG. 6 shows an elevated side view of an alternate embodiment of the jacket of FIG. 2.

Looking now at FIG. 6, one other notable embodiment of jacket (118) includes wrapping the core (101) with a radial wrapping device which dispenses yarn (121) in a helical path around the core (101). This embodiment offers a very fast way to produce an embodiment of jacketed yarn (122). The preferred embodiment is to include two radial wrapped fibers (105) around the core (101) in opposite directions. The coverage is adjustable, within similar limits and with similar results as described above with the open or closed braided jacket respectively (119) or (118).

Additional embodiments and techniques are considered, which are not shown. For example, an additional method to produce the protective jacket (118) is extrusion, as in the manner of a PVC insulated electrical wire. The down side (i.e. disadvantage) of extrusion coating is that the solid coating will produce a stiffer yarn (100) than a braid or fiber wrapped core (101). An extruded layer of a polymer, such as nylon, will provide complete coverage of the core (101). This will contain all the resin present in the core (101), ensuring that no strength is lost and that the yarn (100) is not sticky. After the yarn (100) is produced, it is used in manufacturing a structure. The extruded layers of multiple yarns will be in contact with one another. The structure will then be heated to cure the resin. During or after the resin is cured, the extruded layers may fuse together, either by a chemical welding process or by briefly heating the structure to the extruded layer's melting point until the material just begins to flow, and then cooling it again. This may result in a very strong bond, much stronger than the bond produced by resin.

The following examples are intended as illustrative aids and should not be construed to limit the scope of the instant invention in any way.

Example 1

A core (101) of 12 strands of 3 k prepreg tow (103) containing 60% of Hexcel HexTow® AS4D fiber impregnated with 40% UFXXX TCR™ epoxy resin thermal cure epoxy resin (supplied by TCR composites) was pulled through the center of a 32 carrier horizontal Wardwell Maypole braider (109). The braider (109) was loaded with 16 packages of 200 den Vectran™ fibers which was braided at full coverage around the core (101). The jacketed yarn (100) was cured at 300 F for 3 hours. The cured yarn (100) was observed under light microscopy, was cross sectioned and observed under scanning electron microscopy. The structure of the core (101) was close packed with minimum voids. Tensile strength was essentially as expected from the amount of carbon fiber in the core (101) and the strength of the fibers in the jacket (118).

The uncured yarn (100) was wound onto a braider bobbin (113) for subsequent use on a Maypole braiding machine (109). The yarn (100) was further evaluated by braiding into an open composite structure before curing at 300 F for 3 hours. The yarn was found to exude sufficient resin during curing to form a bond between the braided yarns at their crossover points during curing.

Example 2

A core (101) of 12 strands of 3 k prepreg tow (103) containing 60% of Hexcel HexTow® AS4D fiber impregnated with 40% UFXXX TCR™ thermal cure epoxy resin (supplied by TCR composites) was pulled through the center of a 32 carrier horizontal Wardwell Maypole braider (109). The braider (109) was loaded with 8 packages of 200 den Vectran™ yarn and 4 strands of axial fibers (104) arranged to create the true triaxial braid (119). The braided jacket (119) exhibited which was braided at full coverage around the core (101). The jacketed yarn (101) was cured at 300 F for 3 hours. The cured yarn (101) was observed under light microscopy, was cross sectioned and observed under scanning electron microscopy, tested for tensile strength and bending, and torsion. Although the jacket (119) was lighter weight, the strength of the yarn (100) was about the same as in Example 1.

The yarn (100) was wound onto a braider bobbin (113) for subsequent use on a Maypole braiding machine (109). The yarn (100) was further evaluated by braiding into an open composite structure before curing at 300 F for 3 hours. The yarn was found to exude sufficient resin during curing to form a bond between the braided yarns at their crossover points during curing.

REFERENCES CITED

Jensen, M. J., Jensen, D. W., Howcroft, A. D., Continuous Manufacturing of Cylindrical Composite Lattice Structures, TEXCOMP10 Recent Advances in Textile Composites, edited by Christophe Binetruy, Francois Boussu, 2010, p. 80-87

Structural Analysis of a Two-dimensional Braided Fabric. Q. Zhang, D. Beale, S. Adanur, R. M. Broughton & R. P. Walker, Journal of The Textile Institute, Volume 88, Issue 1, 1997, pages 41-52

U.S. Pat. No. 2,684,318, April 1950, Meek et al.

U.S. Pat. No. 3,007,497, November 1961, Skobert et al.

U.S. Pat. No. 3,644,866, January 1971, Deardurff

U.S. Pat. No. 5,899,134, May 1999, Klein et al.

U.S. Pat. No. 7,132,027, November 2006, Jensen

European Patents

EP 1401378 B1, August 2008, Lassila et al.

What is claimed is:

1. A jacketed composite yarn comprising a plurality of tows pre-impregnated with a resin and defining a core formed from at least 20,000 axially aligned and substantially parallel filaments, the filaments hexagonally packed within an open jacket that defines less than full coverage over the core, wherein the jacket is braided or wrapped around the core, wherein the jacketed composite yarn defines sufficient flexibility to be wound around a cylinder while preserving the axial orientation of the filaments and retraining the filaments within the jacket upon unwinding and wherein a portion of the impregnating resin is formed on a surface of the open jacket facing away from the core.

2. The jacketed composite yarn of claim 1 wherein the core comprises axially aligned, resin infused filaments selected from the group consisting of carbon, para aramid, liquid crystal polyester, and glass.

3. The jacketed composite yarn of claim 1 wherein the core comprises 20,000 to 100,000 individual filaments formed into a plurality of prepreg tows, each tow containing 2,000 to 12,000 filaments each.

4. The jacketed composite yarn of claim 1 wherein the core is comprised of resin infused filaments in which a filament volume fraction is 40-65% relatively to 100% of a core volume.

5. The jacketed composite yarn of claim 1 wherein the jacket is formed from abrasion resistant fiber braided around the core.

6. The jacketed composite yarn of claim 1 wherein the jacket comprises a conventional, biaxial maypole braid with a braid angle less than the natural compressive jammed state.

7. The jacketed composite yarn of claim 1 wherein the jacket comprises a triaxial braid.

8. The jacketed composite yarn of claim 1 wherein the jacket comprises a true triaxial braid.

9. The jacketed composite yarn of claim 1 wherein the jacket comprises a thermoplastic fiber.

10. The jacketed composite yarn of claim 1 wherein the jacket comprises non-thermoplastic fiber that does not melt during curing.

11. A flexible jacketed composite yarn in a cylindrical shape comprising a plurality of tows, each tow containing 2,000 to 12,000 filaments pre-impregnated with resin and defining a core formed from 36,000 to 100,000 axially aligned and substantially parallel filaments, the filaments hexagonally packed within an open jacket defining a true triaxial braid that exhibits less than full coverage over the core, wherein the jacketed composite yarn is sufficiently flexible to wind around a cylinder while preserving the axial alignment of the filaments and retraining the filaments within the jacket upon unwinding, and wherein a portion of the impregnating resin is formed on a surface of the open jacket facing away from the core.

12. The jacketed composite yarn of claim 11 wherein the core is comprised of resin infused filaments in which a filament volume fraction is 40-65% relatively to 100% of a core volume.

13. The jacketed composite yarn of claim 12 wherein the axially aligned, resin infused filaments are selected from the group consisting of carbon, para aramid, liquid crystal polyester, and glass.

* * * * *